United States Patent [19]

Van den Sype

[11] 4,281,429

[45] Aug. 4, 1981

[54] METHOD FOR MAKING FASTENERS

[75] Inventor: Jaak S. Van den Sype, Scarsdale, N.Y.

[73] Assignee: Union Carbide Corporation, New York, N.Y.

[21] Appl. No.: 93,015

[22] Filed: Nov. 9, 1979

[51] Int. Cl.[3] ..... B21K 1/46

[52] U.S. Cl. ..... 10/27 E; 148/12.4

[58] Field of Search ..... 148/12.4; 10/10 R, 27 R, 10/27 E

[56] References Cited

U.S. PATENT DOCUMENTS

| | | | |
|---|---|---|---|
| 1,029,395 | 6/1912 | Muller . | |
| 1,554,336 | 9/1925 | De Lapotterie . | |
| 2,027,980 | 1/1936 | Horton | 10/27 E |
| 2,032,586 | 3/1936 | Lindquist . | |
| 2,113,172 | 4/1938 | Cordes | 10/27 E |
| 3,871,925 | 3/1975 | Nunes | 148/12.4 |
| 4,042,421 | 8/1977 | Van den Sype et al. | 148/12.4 |
| 4,042,423 | 8/1977 | Van den Sype et al. | 148/12.4 |
| 4,161,415 | 7/1979 | Van den Sype et al. | 148/12.4 |

FOREIGN PATENT DOCUMENTS

| | | | |
|---|---|---|---|
| 4627138 | 6/1967 | Japan | 148/12.4 |

*Primary Examiner*—John McQuade

*Attorney, Agent, or Firm*—Saul R. Bresch

[57] ABSTRACT

A method for making a fastener having a head and a shank from a slug consisting essentially of an AISI 200 or 300 series stainless steel having an $Md_{30}$ temperature in the range of about minus 50° C. to about 50° C. comprising the following steps:

(a) cooling the slug to a temperature at least about 50° C. below the $Md_{30}$ temperature of the stainless steel minus 30° C.

(b) extruding a portion of the cooled slug to provide the shank while simultaneously heating the remaining portion of the cooled slug to a temperature in the range of about $Md_{30}$ minus 30° C. to about 500° C.; and (c) upsetting the heated remaining portion to provide the head.

10 Claims, No Drawings

METHOD FOR MAKING FASTENERS

FIELD OF THE INVENTION

This invention relates to a process for making fasteners and, more particularly, to those fasteners having a head and a shank.

DESCRIPTION OF THE PRIOR ART

It is not surprising that high strength fasteners or bolts are advantageous, especially so when, in addition to high tensile strength, they are tough, corrosion-resistant, resistant to stress corrosion cracking, and readily cold forgable (formable) with minimum tool wear, all at reasonable cost. To an engineer/designer these properties are translatable into increased fatigue life, smaller light-weight fasteners, increased clamping loads, increased shear strength, and higher load carrying capacities per fastener.

One class of materials commonly used for fasteners are stainless steels of the AISI 300 series. These steels have excellent formability and corrosion resistance and are widely available at a reasonable cost. In fact, they have all of the above enumerated advantages with one reservation, i.e., the commercially available tensile strengths, while high, are not greater than about 140 ksi (kilopounds per square inch) or 966 Mpa (megapascals). This deficiency comes about because the 300 series stainless steels cannot be hardened, and thus strengthened, by the inexpensive heat treating route. Rather, strength is achieved by the mechanical working which occurs during extrusion of the shank portion of the bolt during cold forging, and by starting with a cold drawn wire. Unfortunately cold drawing of the starting wire can only be used to a limited extent since it is accompanied by a decrease in ductility and a rise in flow stress of the wire, which results in difficulties in the upsetting of the bolt heads and in increased die wear. In view of the limitations on the extent to which the cold drawing can be carried out, and because the strengthening during extrusion is necessarily restricted by process constraints, the AISI 300 stainless steels can only be strengthened up to about 140 ksi (966 Mpa), at least by those techniques which have commercial practicability.

SUMMARY OF THE INVENTION

An object of the invention, therefore, is to provide a method for making fasteners of AISI 300, or AISI 200, stainless steel whereby tensile strengths greater than about 140 ksi (966 Mpa) are achieved in the shank while the upsetting of the head portion occurs under conditions of relatively low flow stress thereby minimizing problems of cracking and of poor die life.

Such a method for making a fastener having a head and a shank from a slug consisting essentially of an AISI 200 or 300 series stainless steel having an $Md_{30}$ temperature in the range of about minus 50° C. to about 50° C. has been discovered comprising the following steps:

(a) cooling the slug to a temperature of at least about 50° C. below the $Md_{30}$ temperature of the stainless steel minus 30° C.;

(b) extruding a portion of the cooled slug to provide the shank while simultaneously heating the remaining portion of the cooled slug to a temperature in the range of about $Md_{30}$ minus 30° C. to about 500° C.; and (c) upsetting the heated portion to provide the head.

DESCRIPTION OF THE PREFERRED EMBODIMENT

The fastener having a head and a shank can, with minor exceptions, be equated with the common bolt, whether in a threaded or unthreaded state. Other fasteners contemplated here are screws and rivets. The process is also particularly suited for forming axisymmetrical components where high strength is desired in the shank portion, while the head portion is not strength-limited. Examples of such components are various types of pins, axles, and plungers.

The AISI Series Designation 200 and 300 stainless steels are described in the "Steel Products Manual: Stainless and Heat Resisting Steels" published by the American Iron and Steel Institute (AISI), now of Washington, D.C., in 1974. The stainless steels contemplated here are austenitic and, at least initially, have an $Md_{30}$ temperature of no higher than about 50° C. (i.e., plus 50° C.) and no lower than about minus 50° C. and an Ms temperature no higher than minus 100° C. AISI stainless steels such as 301, 302, 302 HQ, 303, 303 Se, 304, 304L, 316, 316L, 321, 347, 384, and 385 are preferred for subject process.

The term "austenitic" involves the crystalline microstructure of the alloy, which is referred to as austenitic when the microstructure has a face-centered cubic structure. The other microstructure with which we are concerned here is a body-centered cubic structure and is referred to as martensitic or martensite.

The $Md_{30}$ temperature is defined as the temperature at which, after a true strain in tension of 30 percent, the sample of stainless steel contains 50 percent martensite. True strain is defined as the natural logarithm of the ratio of the final length of the rod or wire divided by its initial length prior to mechanical deformation. The $Md_{30}$ temperature can be determined by a conventional tensile test carried out at various temperatures. Examples of the determination of the $Md_{30}$ temperature for various austenitic stainless steels are given in a paper entitled: "Formation of Martensite in Austenitic Stainless Steels" by T. Angel appearing in the Journal of the Iron and Steel Institute, May 1954, pages 165 to 174. This paper also contains a formula for calculating the $Md_{30}$ temperature from the steel's chemistry:

$$Md_{30}(^\circ C.) = 413 - 462[(C+N)] - 9.2[Si] - 8.1[Mn] - 13.7[Cr] - 9.5[Ni] - 18.5[Mo]$$

where the quantities in square brackets denote the weight percentages of the elements present. This formula can be employed as a useful guideline for the $Md_{30}$ temperature. When the $Md_{30}$ temperature of a stainless steel is referred to in this specification, it always refers to the initial $Md_{30}$ temperature of the stainless steel prior to its undergoing treatment in subject process.

The Ms temperature is defined as the temperature at which martensitic transformation begins to take place spontaneously, i.e., without the application of mechanical deformation. The Ms temperature can also be determined by conventional tests.

Some examples of $Md_{30}$ temperatures are as follows:

| AISI stainless steel type no. | $Md_{30}$ temperature (°C.) |
|---|---|
| 301 | 43 |
| 302 | 13 |
| 304 | 15 |
| 304L | 18 |

The 301, 302, 304 and 304L steels have Ms temperatures below minus 196° C.

Physical properties relevant to the present invention include those of strength and toughness. The strength property can readily be determined from a simple uniaxial tensile test as described in ASTM standard method E-8. This method appears in part 10 of the 1974 Annual Book of ASTM Standards published by the American Society for Testing and Materials, Philadelphia, Pa. The results of this test on a material can be summarized by stating the yield strength, tensile strength, and total elongation of the material: (a) the yield strength is the stress at which the material exhibits a specified limiting deviation from the proportionality of stress to strain. In this specification, the limiting deviation is determined by the offset method with a specified 0.2 percent strain; (b) the tensile strength is the maximum tensile stress which the material is capable of sustaining. Tensile strength is the ratio of the maximum load during a tension test carried to fracture to the original cross sectional area of the specimen; and (c) the total elongation is the increase in gauge length of a tension test specimen tested to fracture, expressed as a percentage of the original gauge length. It is generally observed that when the yield and tensile strengths of metallic materials are increased through metallurgical processes, the total elongation decreases.

The term "slug" is used to describe the metal blank which is used in the process. It is generally a cylindrically shaped piece of metal cut from wire or rod having a diameter somewhere in between the ultimate head diameter and ultimate shank diameter of the finished fastener and a length somewhere in between half the length and the full length of the finished fastener. Selection of the diameter and length will depend on the area reduction and elongation to be accomplished by the extrusion step and the degree of upset during the head forming step. The wire or rod that is used as the source of the slug can be merely in the annealed condition, but is preferably drawn at a temperature in the range of about 15° C. to about 25° C. to provide a reduction in area of up to about 20 percent. The prior drawing of the wire or rod improves lubrication; decreases initial work-hardening at cryogenic temperatures (Ludering effect) thus facilitating cryoextrusion; and increases the column strength of the starting slug thereby reducing buckling risk during cryoextrusion.

The temperature at which step (a) is conducted is at least about 50° C. below the initial $Md_{30}$ temperature of the stainless steel minus 30° C. These temperatures can be achieved by carrying out the step in liquid nitrogen (B.P. minus 196° C.); liquid oxygen (B.P. minus 183° C.); liquid argon (B.P. minus 186° C.); liquid neon (B.P. minus 246° C.); liquid hydrogen (B.P. minus 252° C.); or liquid helium (B.P. minus 269° C.). Liquid nitrogen is preferred. A mixture of dry ice and methanol, ethanol, or acetone has a boiling point of about minus 79° C. and can also be used. The lower the temperature, the less the strain needed for each percent of improvement in tensile strength. It should be noted here that deformation introduces energy into the material and this causes a rise in temperature.

The cooled slug is then extruded as noted in step (b). The terms "extrusion" (more descriptively, forward extrusion) and "extruding" are used here to mean a deformation process in which a part of a cylindrical metal slug is forced by compression to flow through a suitably shaped aperture in a die to give a product of a smaller but uniform cross section. The die in which the extrusion takes place is of conventional design and can be made of tool steel or tungsten carbide. In terms of the length of a cylindrical slug as measured along the axis of the cylinder, the portion which is extruded can vary within wide limits depending on the final desired shape of the cold headed part. The final head diameter to shank diameter ratio will however usually be less than 3. The reduction in area of the extruded portion, now the shank, is about 10 to about 30 percent and preferably about 15 to about 25 percent. During cryoextrusion, at least about 20 percent of the shank microstructure converts to martensite resulting in substantial hardening. Further, heat is generated in the shank through work of deformation, heat of transformation of austenite to martensite, and friction at the material-die interface. In carrying out step (b), the head portion of the slug is usually enclosed by a conical tool. This conical tool forces the shank into the extrusion die and it is supposed to prevent the head portion from buckling. A partial upsetting may take place, however. In any case, the head section of the slug is in excellent thermal contact with the conical tool and the shank portion of the bolt. The heat generated in the shank passes into the remaining portion of the slug by conduction and, together with the heat obtained during the transfer from the extrusion die to the upsetting die, increases the temperature of the head portion of the slug to a temperature in the range of about $Md_{30}$ minus 30° C. to about 50° C. It is clear that the temperature of the head portion of the slug can be increased above this range by artificially applying heat to the conical tool which forces the shank into the extrusion die or by applying heat to the head portion of the slug while it passes from the extrusion die to the upsetting die. This further heating will be particularly useful for difficult to form head styles (such as a recessed head) when maximum ductility and softness are required in the head portion of the slug in order to avoid cracking during forming and to achieve adequate tool life. The maximum temperature to which the head portion of the slug can be heated is about 500° C., determined by the stability of the martensite in the shank portion. It is found that no softening or reversion of the martensite formed during the cryoextrusion step takes place up to about 500° C. The preferred range is about 0° C. to about 500° C. It will be understood by those skilled in the art that it is more expensive to operate between 50° C. and 500° C. than from 0° C. to 50° C. because of the cost of applying the external heat. Therefore, common head styles will be ordinarily produced in the lower range with no external heating. Other than cost, there is no obstacle to the use of the higher temperatures, however.

The temperature to which the cooled shank rises during extrusion will depend on the temperature to which it was cooled in step (a). The heat generated during the cryoextrusion step is usually sufficient to drive the temperature of the shank up by about 150° C. to about 250° C. for a 20 percent area reduction, e.g. a shank cooled to minus 196° C. in step (a) can rise to 20°

C. in step (b). Step (c) is then undertaken by upsetting this remaining portion to provide or form the head of the fastener. The term "upsetting" or "heading" is used here to mean a deformation process wherein the metal is subjected to compressive deformation by a blow or steady pressure generally in the direction of the axis of the slug in order to enlarge the cross sectional area over part of its length. The upsetting dies are of conventional design and can be made out of tool steel or tungsten carbide. In a typical progressive header operating on 0.25 inch diameter AISI 304 stainless steel slugs at 150 slugs per minute with the slugs cooled (step (a)) to minus 123° C. and with tooling at 27° C., the average head temperature before upsetting (i.e., after step (b) but before step (c)) in the second die is about minus 13° C. In any case, the upsetting or heading operation takes place at or above the $Md_{30}$ less 30° C. temperature of the alloy from which the slug is made. Little martensite, less than about 20 percent, is formed in the head portion during upsetting resulting in moderate work-hardening and high ductility. Thus, the finished bolt will have as a composite structure: a more martensitic shank of high strength and toughness and a more austenitic head. At any rate, the martensite content of the shank portion will be at least about 20 percent higher than the martensite content of the head portion. The strength, i.e., tensile strength, is in the range of about 150 ksi (1,034 Mpa) to about 250 ksi (1,724 Mpa).

After step (c), it is preferred that the finished fastener or bolt be aged to optimize strength. Aging is carried out in a conventional manner at a temperature in the range of about 400° C. to about 450° C. Aging time can range from about 30 minutes to about 10 hours and is preferably in the range of about 30 minutes to about 2.5 hours. Conventional testing is used here to determine the temperature and time, which give the highest tensile strength and yield strength.

It wll be noted, that aging tends to improve yield strength even more than tensile strength, and for the alloy to reach the highest strength levels can be carried to a point where yield strength approximates the tensile strength.

When the bolt is subjected to aging the tensile strength of the shank portion is increased by an amount in the range of about 20 ksi (138 Mpa) to about 50 ksi (345 Mpa) while the head portion is constant in strength or weakens slightly. This strengthening effect is a further advantage of the subject cryoextrusion process.

The invention is illustrated by the following example:

EXAMPLE

In this example a bolt is produced from an AISI 304L stainless steel cylindrical slug on a progressive header. The chemistry of the material is (weight percent):

C: 0.017
Mn: 0.55
P: <0.04
S: 0.006
Si: 0.54
Cr: 18.8
Ni: 8.3
Fe: balance

Annealed rod from this material is conventionally drawn at room temperature with approximately 30 percent area reduction resulting in a 0.22 inch diameter wire with a yield strength of 128 ksi (883 Mpa) and a tensile strength of 154 ksi (1,062 Mpa).

The term "progressive header" denotes a conventional solid die machine with two or more separate stations for various steps in the operation. The slug is automatically transferred from one station to the next and the machine can perform one or more extrusions and upsets on the slug. Most progressive headers used in high speed production are fed by coiled wire stock. The stock is fed into the machine by feed rolls and the first step is a cut-off stage which produces cylindrical slugs, each having a 1.3 inch length and a diameter of 0.22 inch. The slugs are then cooled with liquid nitrogen to minus 196° C. as in step (a). The machines, the punches and the dies are all at about 27° C. (room temperature). The slugs then pass through an extrusion die (step (b)) where 62 percent of the length (0.8 inch) is extruded to provide a shank diameter of 0.197 inch with a reduction in area of 20 percent and a shank length of 1 inch. The punch speed is 5 inches per second and tungsten carbide extrusion dies are used. The lubricant used during the cryoextrusion is a conventional dry lubricant for stainless steel: a mixture of calcium stearate and lime. After step (b) and before step (c) the head temperature rises to above 0° C. The slugs then pass through the upsetting die in which the head is formed, the composite structure having a shank diameter of 0.197 inch and a head diameter of 0.33 inch. The bolts are subjected to aging for 2 hours at 450° C.

Of critical importance for the proper mechanical functioning of the composite bolt produced by the process is that the transition between the high strength cryoextruded shank and the lower strength head be sufficiently sharp so that the finished bolt can carry loads equal to the shank strength without permanent deformation in the transition region near the head. A cryoextruded slug (after step (b)) is cut longitudinally along the center and the hardness is measured along the centerline. The average hardness of the shank is 44 on the Rockwell C scale corresponding to a tensile strength of 194 ksi (1,338 Mpa). The transition region is less than 0.03 inch long and is mainly determined by the conical angle of the extrusion die (12°). This indicates that very short transition regions can be readily achieved.

After aging for 2 hours at 450° C. the shank portion reaches a hardness of 51 on the Rockwell C scale corresponding to a tensile strength of 255 ksi (1,758 Mpa).

It is found that the fasteners prepared by this method exhibit high strength when subjected to the ASTM test mentioned above, the strength being upwards of about 150 ksi (1,035 Mpa), and toughness.

I claim:

1. A method for making a fastener having a head and a shank from a slug consisting essentially of an AISI 200 or 300 series stainless steel having an $Md_{30}$ temperature in the range of about 50° C. to about 50° C. comprising the following steps:

(a) cooling the slug to a temperature of at least about 50° C. below the $Md_{30}$ temperature of the stainless steel minus 30° C.;

(b) extruding a portion of the cooled slug to provide the shank while simultaneously heating the remaining portion of the cooled slug to a temperature in the range of about $Md_{30}$ minus 30° C. to about 500° C.; and (c) upsetting the heated portion to provide the head.

2. The method defined in claim 1 wherein, after step (c), the fastener is aged at a temperature in the range of about 400° C. to about 450° C.

3. The method defined in claim 2 wherein the temperature in step (a) is less than about minus 100° C.; and the remaining portion in step (b) is heated to a temperature in the range of about 0° C. to about 500° C.

4. The method defined in claim 3 wherein, the slug used in step (a) is made from wire or rod drawn at a temperature in the range of about 20° C. to about 200° C. to provide a reduction in area of about 5 percent to about 50 percent.

5. The method defined in claim 1 wherein the stainless steel is from the AISI 300 series.

6. The method defined in claim 2 wherein the stainless steel is from the AISI 300 series.

7. The method defined in claim 3 wherein the stainless steel is from the AISI 300 series.

8. The method defined in claim 4 wherein the stainless steel is from the AISI 300 series.

9. The method defined in claim 1 wherein step (c) is carried out at a temperature of at least about the initial $Md_{30}$ of the stainless steel less about 30° C. in such a manner that less than about 20 percent martensite is formed in the head.

10. The method defined in claim 8 wherein step (c) is carried out at a temperature of at least about the initial $Md_{30}$ of the stainless steel less about 30° C. in such a manner that less than about 20 percent martensite is formed in the head.

* * * * *

UNITED STATES PATENT AND TRADEMARK OFFICE

CERTIFICATE OF CORRECTION

PATENT NO. : 4,281,429

DATED : August 4, 1981

INVENTOR(S) : Jaak S. Van den Sype

It is certified that error appears in the above—identified patent and that said Letters Patent is hereby corrected as shown below:

Column 6, line 55, after "about" (first occurrence), insert --minus--.

Signed and Sealed this

*Thirteenth* Day of *October 1981*

[SEAL]

*Attest:*

GERALD J. MOSSINGHOFF

*Attesting Officer*

*Commissioner of Patents and Trademarks*